US009286825B2

(12) United States Patent
Li et al.

(10) Patent No.: US 9,286,825 B2
(45) Date of Patent: Mar. 15, 2016

(54) APPARATUS AND METHOD FOR DRIVING LED DISPLAY

(71) Applicant: SCT TECHNOLOGY, LTD., Grand Cayman (KY)

(72) Inventors: Eric Li, Milpitas, CA (US); Shean-Yih Chiou, San Jose, CA (US); Shang-Kuan Tang, Fremont, CA (US); Xinchao Peng, Guangzhou (CN)

(73) Assignee: SCT TECHNOLOGY, LTD., Grand Cayman (KY)

( * ) Notice: Subject to any disclaimer, the term of this patent is extended or adjusted under 35 U.S.C. 154(b) by 134 days.

(21) Appl. No.: 14/056,699

(22) Filed: Oct. 17, 2013

(65) Prior Publication Data

US 2015/0109284 A1 Apr. 23, 2015

(51) Int. Cl.

| | |
|---|---|
| ***G09G 3/32*** | (2006.01) |
| ***G09G 3/20*** | (2006.01) |
| ***G09G 5/12*** | (2006.01) |

(52) U.S. Cl.

CPC ..... *G09G 3/32* (2013.01); *G09G 3/2088* (2013.01); *G09G 5/12* (2013.01); *G09G 2330/06* (2013.01)

(58) Field of Classification Search

None

See application file for complete search history.

(56) References Cited

U.S. PATENT DOCUMENTS

| | | | | |
|---|---|---|---|---|
| 2010/0066765 | A1* | 3/2010 | Lee | 345/690 |
| 2011/0103427 | A1* | 5/2011 | Bafra et al. | 375/130 |

* cited by examiner

*Primary Examiner* — Kenneth B Lee, Jr.

(74) *Attorney, Agent, or Firm* — Novick, Kim & Lee, PLLC; Allen Xue

(57) ABSTRACT

The apparatus for driving LED display includes a system control unit having a synchronization signal generator configured to generate a synchronization start signal and a plurality of phase locked loop circuits. Each of the phase locked loop circuits includes a divider coupled to the voltage controlled oscillator and configured to change the sequence of dividing ratios over a modulation period, a sigma delta modulator configured to generate a sequence of random numbers to the divider, and a spread spectrum modulation depth controller coupled to the sigma delta modulator and configured to receive the synchronization start signal from the synchronization signal generator. Upon receipt of the synchronization start signal, the spread spectrum modulation depth controller starts a spread spectrum modulation.

19 Claims, 12 Drawing Sheets

APPARATUS AND METHOD FOR DRIVING LED DISPLAY

UTILITY PATENT APPLICATION

1. Field of the Invention

This invention relates generally to an apparatus and a method for driving LED display.

2. Background of the Invention

Light emitting diode (LED) is widely used for displaying information and message. LED is a solid state device that converts electric energy to light and requires reduced operational voltage and current. LED provides a higher level of brightness and greater optical efficiency as compared to other types of display panels.

The LED display panel includes an LED array having a plurality of LED driver chips as shown in FIG. 1. The total number of the plurality of LED driver chips can vary depending on the size and resolution of the LED display panel.

For example, a high definition LED display panel can require 1,280×720 pixels. If each driver chip controls of 64×16 LED pixels, then it will need a total of 900 driver chips. If 900 driver chips start to operate at the same time in response to a single serial clock signal, it will cause problematic electromagnetic radiation, such as Electromagnetic Interefernce (EMI). Thus, for the high definition LED or a large-size LED display panel, EMI radiation is a problem.

To attenuate EMI radiation, the spread spectrum modulation depth controller can be used so that a modulation is performed with respect to the input frequency of a reference clock signal in an LED driver chip to spread the spectrum of an output clock signal, thereby reducing the peak value of EMI.

However, when a plurality of spread spectrum modulation depth controllers are used, it is considerably more difficult to synchronize them. That is because the spread spectrum modulation depth controllers automatically start when the phase locked loops operate. The starting point of each of the spread spectrum modulation depth controllers is influenced by interference factors including an external power ramp rate and an IC process skew. Thus, because of such interferences, each of the spread spectrum modulation depth controllers starts at its respective time.

The unsynchronization of the plurality of spread spectrum modulation depth controllers causes a problem. For example, when there are two LED driver chips that start at different times, two modulation profiles of the LED driver chips may have a phase difference. FIG. 2 is a graph that shows a 180 degree out of phase relation between two modulation process. With reference to FIG. 2, each of spread spectrum is set to have a +/−1.0% spread spectrum modulation depth. The frequency variations between the two driver chips can be up to 2% at a point as shown in FIG. 2. Such variations between driver chips may cause an uniformity of a light intensity issue on the LED display panel.

SUMMARY OF THE INVENTION

In view of the aforementioned problems, the present disclosure provides an apparatus and a method for synchronizing a plurality of spread spectrum modulation depth controllers.

According to an embodiment of the present disclosure, an apparatus for driving LED display may include a system control unit having a synchronization signal generator configured to generate a synchronization start signal, and a plurality of phase locked loop circuits, each of the phase locked loop circuits comprising a phase frequency detector configured to generate a phase difference signal according to a frequency divided signal and a reference frequency signal, a charge pump configured to receive the phase difference signal and to generate an output current according to the phase difference signal to adjust phase alignment, a loop filter configured to receive the output current and to convert the output current to a voltage controlled signal, a voltage controlled oscillator configured to receive the voltage controlled signal and to generate a voltage controlled output signal, a divider coupled to the voltage controlled oscillator and configured to change the sequence of dividing ratios over modulation periods, a sigma delta modulator configured to generate a sequence of random numbers to the divider; and a spread spectrum modulation depth controller (spread spectrum controller) coupled to the sigma delta modulator and configured to receive the synchronization start signal from the synchronization signal generator, wherein upon receipt of the synchronization start signal the spread spectrum controller starts a spread spectrum modulation.

The synchronization signal generator may transmit the synchronization signal to the spread spectrum modulation depth controller after the system control unit is configured to change the a spread spectrum modulation depth of the spread spectrum controller.

The spread spectrum modulation depth may be in a range of −9.9% to 9.9%. The system control unit may change the spread spectrum modulation depth of the spread spectrum controller after a predetermined period of time from when each of the phase locked loop circuits receives a power on reset signal. The predetermined period of time may be a time when the phase locked loop circuits are locked up. The predetermined period of time may be less than 200 milliseconds.

The plurality of phase locked loop circuits may be divided into a plurality of groups in accordance with locations and the synchronization signal generator transmits a plurality of synchronization start signals to the plurality of groups respectively with a time difference.

The apparatus may be a LED display panel having an array of rows and columns, and the rows and columns are divided into the plurality of groups. The time difference may be controlled by the system control unit. The time difference may be smaller than a predetermined time difference.

According to another embodiment of the present disclosure, a method for driving LED display is provided. The method may include receiving a power-on-reset signal to operate a plurality of phase locked loop circuits, changing a spread spectrum modulation depth of each of the phase locked loop circuits after a predetermined period of time, transmitting a synchronization start signal from a synchronization signal generator on a system control unit to the plurality of the spread spectrum controllers so as to start a spread spectrum modulation process. Each of the spread spectrum controllers may be coupled to each of the phase locked loop circuits.

The predetermined period of time may be a time when the phase locked loop circuits are locked up. The step of transmitting the synchronization start signal may include to transmit the synchronization start signal to the plurality of spread spectrum controllers all together so that the plurality of spread spectrum controllers start the spread spectrum modulation process synchronously.

The plurality of phase locked loop circuits may be divided into a set of groups in accordance with locations, and the step of transmitting the synchronization start signal may include a step of transmitting a plurality of synchronization start signals from the synchronization signal generator to the groups respectively with a time difference.

The plurality of spread spectrum controllers may be a part of a LED display panel having an array of rows and columns, and the rows and columns are divided into the groups. The time difference may be controlled by a system control unit. The time difference may be smaller than a predetermined value. The synchronization start signal may be transmitted after changing the spread spectrum modulation depth. The spread spectrum modulation depth may be in a range of −9.9% to 9.9%.

According to a further embodiment of the present disclosure, an apparatus for driving LED display may include a system control unit comprising a synchronization signal generator configured to generate a synchronization start signal and a plurality of phase locked loop circuits. Each of the phase locked loop circuits may include a phase frequency detector configured to generate a phase difference signal according to a frequency divided signal and a reference frequency signal, a charge pump configured to receive the phase difference signal and to generate an output current according to the phase difference signal to adjust phase alignment, a loop filter configured to receive the output current and to convert the output current to a voltage controlled signal, a voltage controlled oscillator configured to receive the voltage controlled signal and to generate a voltage controlled output signal, a divider coupled to the voltage controlled oscillator and configured to change the sequence of dividing ratios over modulation periods, a sigma delta modulator configured to generate a sequence of random numbers to the divider, and a spread spectrum controller coupled to the sigma delta modulator and configured to receive the synchronization start signal from the synchronization signal generator, wherein upon receipt of the synchronization start signal the spread spectrum controller starts a spread spectrum modulation, and the synchronization signal generator transmits the synchronization signal to the spread spectrum controller after the system control unit is configured to change a the spread spectrum modulation depth of the spread spectrum controller, and the system control unit changes the spread spectrum modulation depth of the spread spectrum controller after a predetermined period of time from when the phase locked loop circuits are locked up, wherein the plurality of phase locked loop circuits are divided into a plurality of groups in accordance with locations and the synchronization signal generator transmits a plurality of synchronization start signals to the plurality of groups respectively with a time difference, and wherein the apparatus further comprises an array of rows and columns, and the rows and columns are divided into the groups.

DETAILED DESCRIPTION OF THE PREFERRED EMBODIMENT

Figure 1:
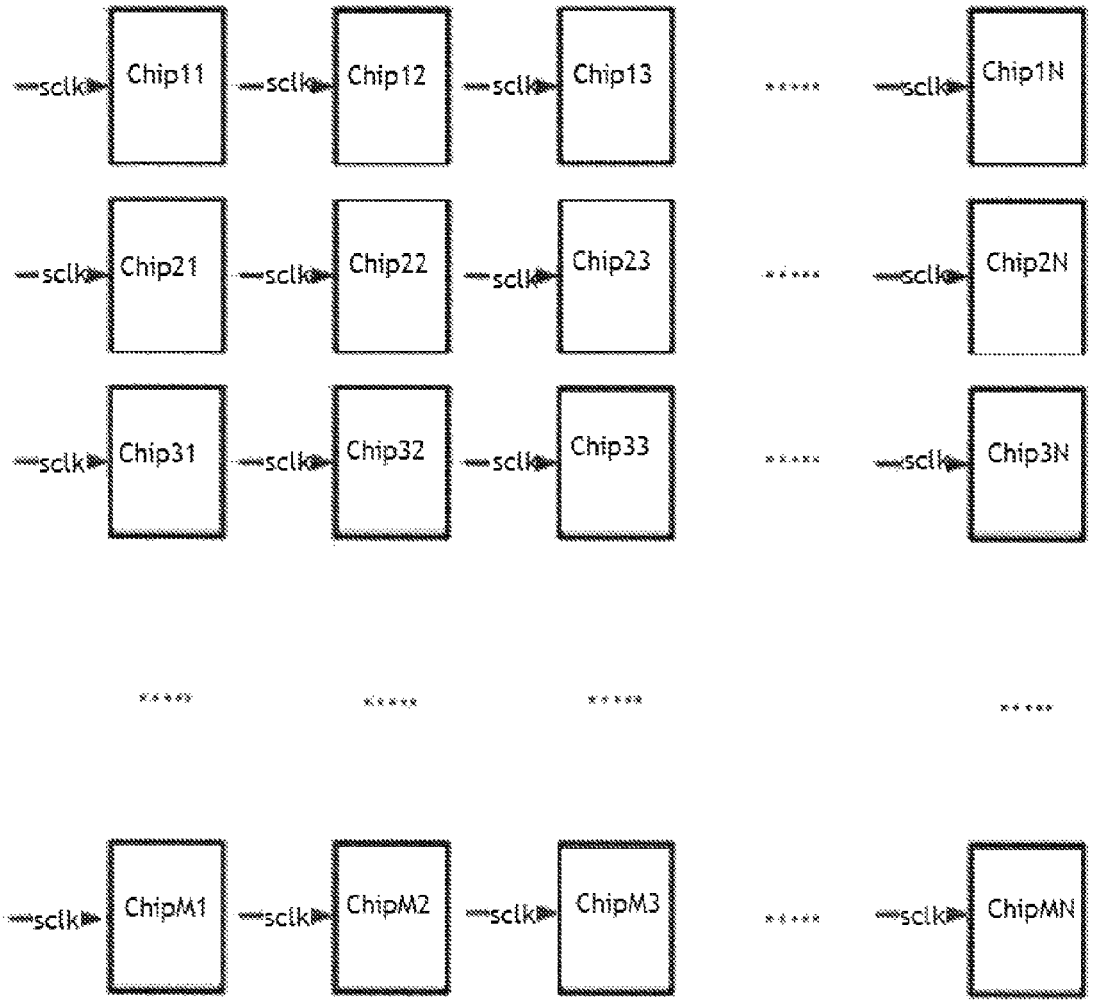
FIG. 1 is a schematic block diagram of an LED array having a plurality (M×N) of LED driver chips.
Figure 2:
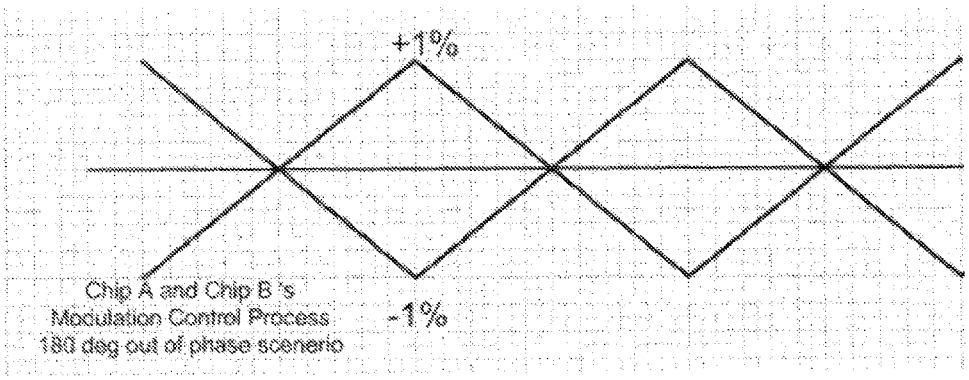
FIG. 2 is a graph that shows a 180 degree out of phase relation between two modulation process.

Reference will now be made in detail to embodiments, examples of which are illustrated in the accompanying drawings, wherein like reference numerals refer to the like elements throughout the several views. In this regard, the present embodiments may have different forms and should not be construed as being limited to the descriptions set forth herein. Accordingly, the embodiments are merely described below, by referring to the figures, to explain aspects of the present description. Terms used herein are for descriptive purposes only and are not intended to limit the scope of the disclosure. The terms "comprises" and/or "comprising" are used to specify the presence of stated elements, steps, operations, and/or components, but do not preclude the presence or addition of one or more other elements, steps, operations, and/or components. The terms "first," "second," and the like may be used to describe various elements, but do not limit the elements. Such terms are only used to distinguish one element from another. These and/or other aspects become apparent and are more readily appreciated by those of ordinary skill in the art from the following description of embodiments of the present disclosure, taken in conjunction with the accompanying drawings. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 3:
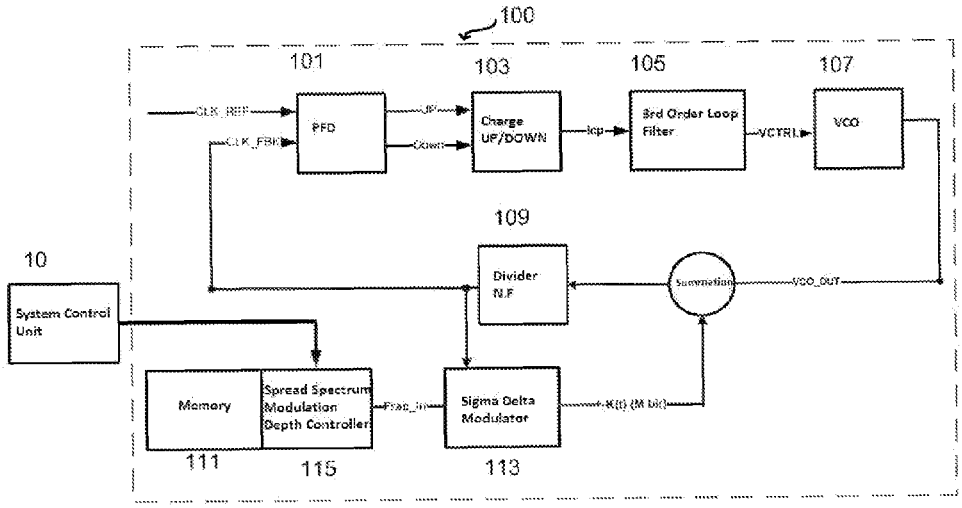
FIG. 3 is a schematic block diagram showing a configuration of a phase locked loop with a spread spectrum modulation depth controller according to an embodiment of the present disclosure.

FIG. 3 is a schematic block diagram showing a configuration of a phase locked loop 100 according to an embodiment of the present disclosure. Although the apparatus for driving LED display can include a plurality of phase locked loops, a single phase locked loop 100 is depicted with reference to FIG. 3 for exemplary purpose only.

The phase locked loop 100 includes a phase frequency detector (PFD) 101, a charge pump 103, a loop filter 105, a voltage controlled oscillator (VCO) 107, a divider 109, a memory 111, a digital sigma delta modulator 113, and a spread spectrum modulation depth controller 115.

The PFD 101 is configured to generate a phase difference signal according to a frequency divided feedback signal and a reference frequency signal. PFD 101 receives the divided feedback signal and the reference signal, and outputs a phase difference signal.

The charge pump 103 is configured to receive the phase difference signal and generates an output current according to the phase difference signal to adjust a phase alignment. The charge pump 103 changes a charging current.

The loop filter 105 is configured to receive the output current and converts the output current to a voltage controlled signal. The loop filter 105 uses a higher order filter to reduce various types or source of phase noise and harmonics. For example, the loop filter 105 can be configured to use a $3^{rd}$ order loop filter to reduce noise.

The VCO 107 is configured to receive the voltage controlled signal and generates a voltage controlled output signal. The VCO 107 oscillates at a frequency depending on the voltage controlled signal.

The divider 109 is coupled to the VCO 107 and configured to change the dividing ratio over the modulation period in accordance with a pattern generated by the spread spectrum modulation depth controller 115 coupled with the sigma delta modulator 113. The dividing ratio can always be expanded into various expressions of equivalent fraction expansions. The phase locked loop 100 is a fractional phase locked loop that can multiply by an integer and a fraction. The fractional value can be continuously changed over the modulation period so as to spread the spectrum evenly over the range specified. The divider 109 divides a frequency of the voltage controlled output signal from the VCO 107 to generate the divided feedback signal.

The memory 111 is configured to contain the modulation profile codes, such as triangular shape with a percentage adjustment. The memory 111 may include a ROM, a RAM, and a form of flip-flop. The memory 111 generates the M bit in 2's complement format. The VCO frequency will be modulated by the memory codes coupling with a sequence of randomized output data from the digital sigma delta modulator 113.

The sigma delta modulator 113 is configured to reduce the noise which generated from the fluctuation of the divider 109. It shifts the noise to high frequencies so that it becomes easier to filter the noise out and attenuates phase noise to insignificant levels close to the center frequency. The sigma delta modulator 113 takes M bit codes in 2's complement format from the memory 111 and generates a sequence of random numbers to modulate the modulus_N divider 109. The loop filter 105 with a high order and the sigma delta modulator 113 are configured to achieve precise frequency variations within one full modulation cycle. At the same time, they function to keep the cycle to cycle jitter low in the modulation cycle.

The spread spectrum controller unit includes the spread spectrum modulation depth controller 115 and the sigma delta modulator 113. It is configured to adjust a spread spectrum modulation depth. The spread spectrum modulation depth is a frequency range over which the clock makes the frequency excursion at the rate of a modulation rate. The spread spectrum modulation depth is denoted by the percentage (%) spread which is the ratio of the band of frequency excursion to the output clock frequency. For example, a 100 MHz clock with a −1.0% to +1.0% spread spectrum modulation depth indicates that the modulated clock frequency is varying within a band of 99 MHz to 101 MHz. This determines the amount of peak EMI reduction. Generally, the higher the spread spectrum modulation depth, the greater is the EMI reduction. The modulation rate is the rate at which the energy of the clock source is distributed over the band of frequencies around the output clock frequency. Modulation profile will determine the effectiveness of the peak EMI reduction.

The spread spectrum modulation depth controller unit is configured to receive a synchronization start signal. Upon receiving the synchronization start signal, the spread spectrum modulation depth controller unit starts a spread spectrum modulation. The spread spectrum modulation depth controller unit is invariant to PVT (process, voltage, and temperature) characteristics or conditions. The starting point of each of the spread spectrum modulation depth controller units is not influenced by interference factors of the external power ramp rate and the IC process skew of the LED driver chips. That is because the synchronization start signal is an external signal from outside of the LED driver chips, and the spread spectrum modulation depth controller 115 starts a spread spectrum modulation by the synchronization start signal. Thus, such starting mechanism of the spread spectrum modulation depth controller unit ensures not only EMI reduction but also a synchronization among the LED driver chips. The synchronization mechanism also manages a jitter control between the LED driver chips. Thus, the apparatus with the synchronization start signal mechanism is suitable for high resolution LED display panel.

A spread spectrum modulation depth controller unit will be further described with reference to FIG. 4. The starting mechanism of the synchronization start signal will be discussed with FIG. 5 with greater details.

Figure 4:
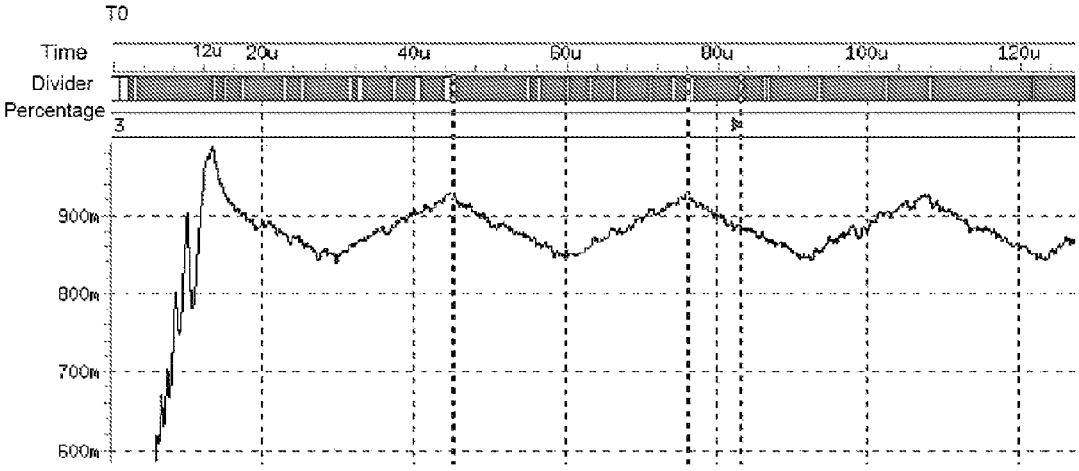
FIG. 4 is a graph showing a control voltage signal for VCO having a 128 MHz clock with a −3.0% to +3.0% modulation depth without synchronous start control.

FIG. 4 is a graph showing a control voltage signal for the VCO 107 having a 128 MHz clock with a −3% to +3% modulation depth without synchronous start control.

The memory 111 generates the M bit in 2's complement format as shown in FIG. 3. The 2's complement format numbers are input to the sigma delta modulator 113. The sigma delta modulator 113 generates divider values which feed into the modulus_N divider 109. In FIG. 4, the divider starts in a millisecond after time T0. A divider value changes over the modulation period reflecting to the fluctuation of the voltage controlled signal for the VCO 107. The X-axis of the graph as shown in FIG. 4 indicates a time measured in microseconds (μs). The spread spectrum modulation depth in spread spectrum modulation depth controller 115 is also denoted by the percentage spread 3 at Time T0, which means that the percentage of modulation depth starts from 3% at time T0. After a millisecond from the modulation depth change at time T0, the sigma delta modulator 113 generates a divider value between 0 and 5 μs. The spread spectrum modulation depth controller can automatically start around time T0 or any given time. As explained above, due to various interference factors of the LED driver chips, the starting point of spread spectrum modulation can vary. Furthermore, where each of the phase locked loops received a power-on-reset signal to initiate its process, it is difficult to control the power-on-reset signals in a synchronous manner so that the starting point can further vary. The spread spectrum modulation depth can be set in a range of −5% to 5%. However, the range is not limited thereto.

Figure 5:
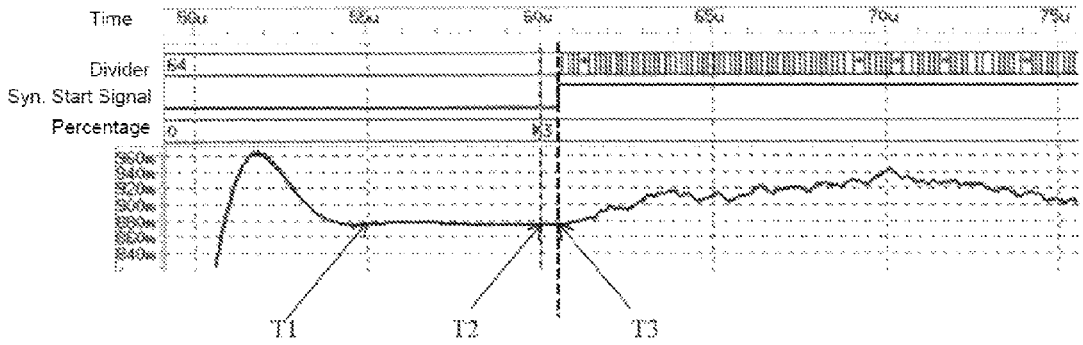
FIG. 5 is a graph showing a control voltage signal for VCO having a 130.56 MHz clock with −3.0% to +3.0% modulation depth with a synchronization start signal.

FIG. 5 is a graph showing voltage controlled signal for the VCO 107 having a 130.56 MHz clock with −3% to +3% modulation depth with synchronization start signal. Each of the phase locked loop circuits receives a power-on-reset signal at T0 (not shown), and at that time the spread spectrum modulation depth runs at no spread mode (0%). After a millisecond period of time GCLK of the phase locked loop is locked at T1. The system control unit 10 of FIG. 3 is configured to change the spread spectrum modulation depth. After GCLK is locked, the system control unit 10 changes the spread spectrum modulation depth at T2 from 0% to 3%. The spread spectrum modulation controller 115 does not start its process at T2 but is ready to receive the synchronization start signal.

The system control unit 10 includes a synchronization signal generator (not shown). The synchorination signal generator sends the synchronization start signal to each of the LED driver chips in LED display panel at a starting point T3.

Time T0, T1, T2 and T3 satisfy the following inequaility 1.

$$T0<T1<T2\leq T3 \quad \text{[Inequality 1]}$$

After a predetermined period of time from T0, T1 or T2, the system control unit 10 transmits a synchronization start signal at T3 so as to operate the plurality of spread spectrum modulation depth controllers in a synchronous manner. The predetermined period of time is a programmable value and can be measured as the time between the starting point T3 and a power-on-reset signal receipt time at T0 (T3-T0), between the starting point T3 and a time when the GCLK signal is locked at T1 (T3-T1), or between the starting point T3 and a time when the modulation depth is changed at T2 (T3-T2). The predetermined period of time, for instance, can be less than 60 milliseconds.

The system control unit 10 transmits the synchronization start signal so as to operate the plurality of spread spectrum modulation depth controllers in a synchronous manner. The starting point T3 of the synchronization start signal is invariant to the external power ramp rate and the IC process skew. Thus, upon receiving the synchronization start signal, the plurality of spread spectrum modulation depth controllers start spread spectrum modulation actions in a synchronous manner.

The LED display panel has a volume of the LED driver chips to synchronize among themselves. Regardless of the variation of interference factors that each of the LED driver chips may have, the plurality of spread spectrum modulation depth controllers across the LED display panel start spread spectrum modulation actions in a synchronous manner according to the synchronization start signal. The spread spectrum modulation depth may be in a range of −9.9% to 9.9%.

Figure 6A:
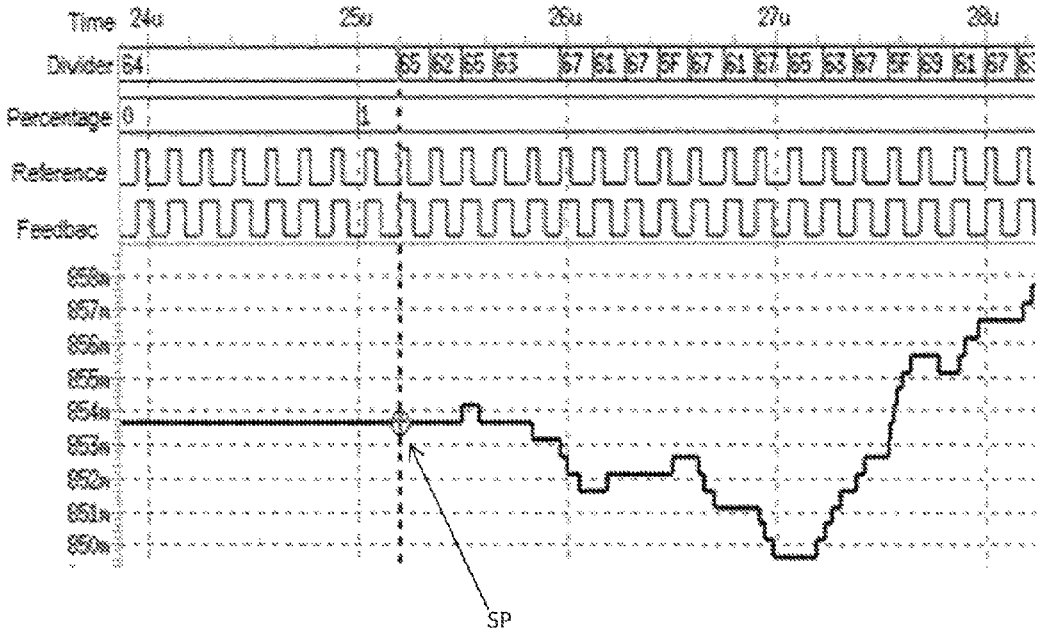
FIG. 6A is a graph showing a control voltage signal for VCO having a 128 MHz clock with a −1.0% to +1.0% modulation depth with synchronous start control.
Figure 6B:
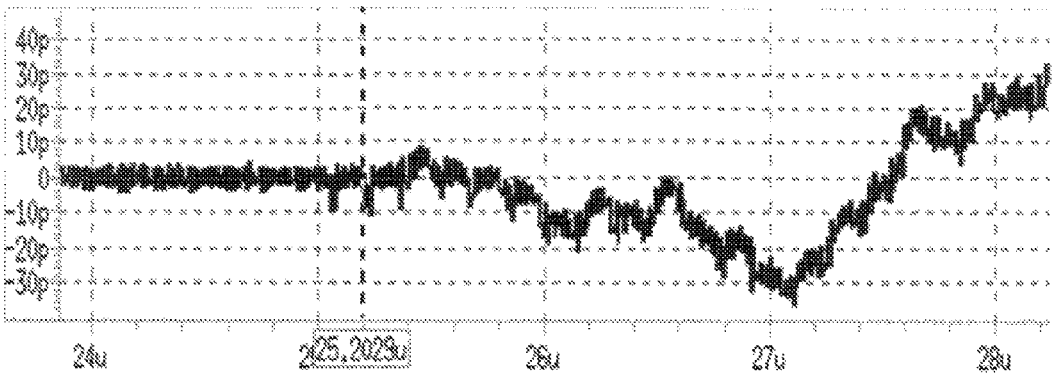
FIG. 6B is a graph showing a jitter distribution having a 128 MHz clock with a −1.0% to +1.0% modulation depth with synchronous start control.

FIG. 6A is a graph showing a voltage controlled signal for the VCO 107 having a 128 MHz clock with a −1.0% to +1.0% modulation depth with synchronous start control. FIG. 6B is a graph showing a jitter distribution having a 128 MHz clock with a −1% to +1% modulation depth with synchronous start control.

The memory 111 generates the M bit in 2's complement format as shown in FIG. 3. The 2's complement format numbers are input to the sigma delta modulator 113. The sigma delta modulator 113 generates divider values which are fed into the modulus_N divider 109. In FIG. 6A, the divider values are denoted as 64, 65, 62, 63, 67, 61, 67, and 5F in hex codes along with X-axis. The hex codes can be converted to decimal divider values as 100, 101, 98, 103, 97, 103, and 95. The divider value changes over the modulation period which is reflected to the fluctuation of the voltage controlled signal for the VCO 107. The X-axis of the graph as shown in FIGS. 6A and 6B indicates a time measured in microseconds (μs). The modulation depth in spread spectrum modulation depth controller 115 is also denoted by the percentage spread (%) along with Y-axis. FIG. 6A shows that the percentage of modulation depth starts from 0% and changes to 1% at 25 μs. After the modulation depth change, the sigma delta modulator 113 generates a divider value of 65 at 25.2 μs. Thus, a starting point (SP) of the spread spectrum modulation depth controller is at 25.2 μs. The spread spectrum modulation depth controller can start upon receipt of synchronization signal from the system control unit 10.

FIG. 6B depicts a graph of jitter distribution of an embodiment of FIG. 6A over time. The jitter distribution curve reflects the frequency changes of the voltage controlled signal for the VCO 107. Output values of the sigma delta modulator 113 reflect its input values that has a variation in a range of −1.0% to +1.0%.

Figure 7A:
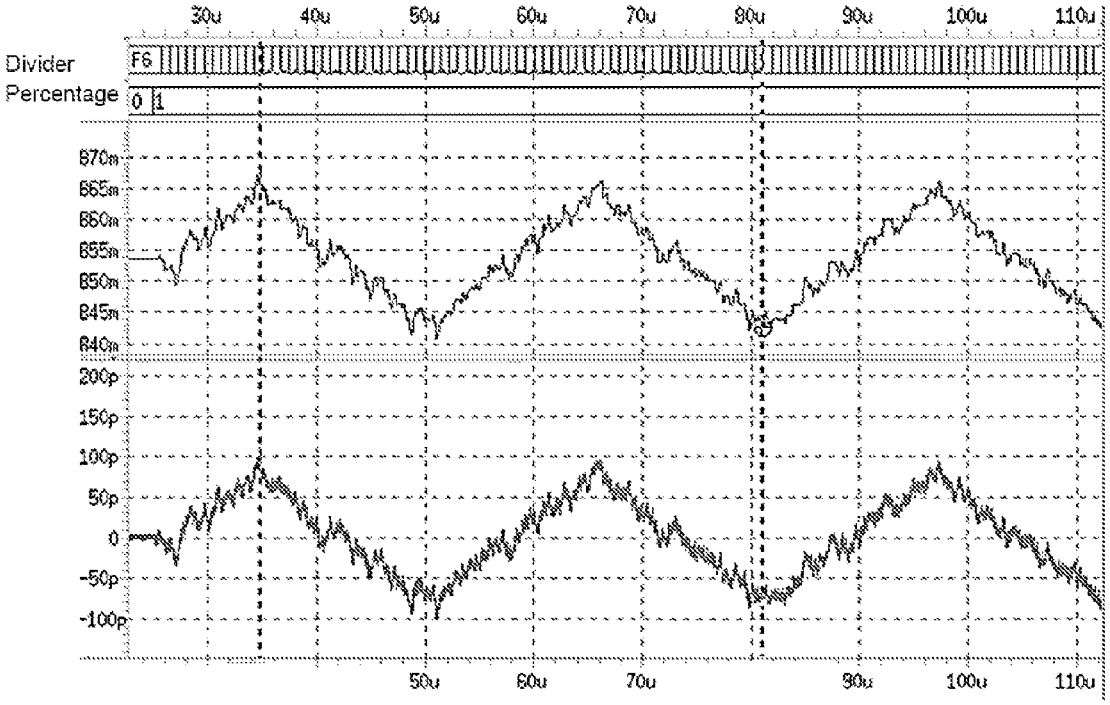
FIG. 7A is a graph showing a triangle shape control voltage signal for VCO and jitter distribution having a 128 MHz clock with a −1.0% to +1.0% modulation depth with synchronous start control.
Figure 7B:
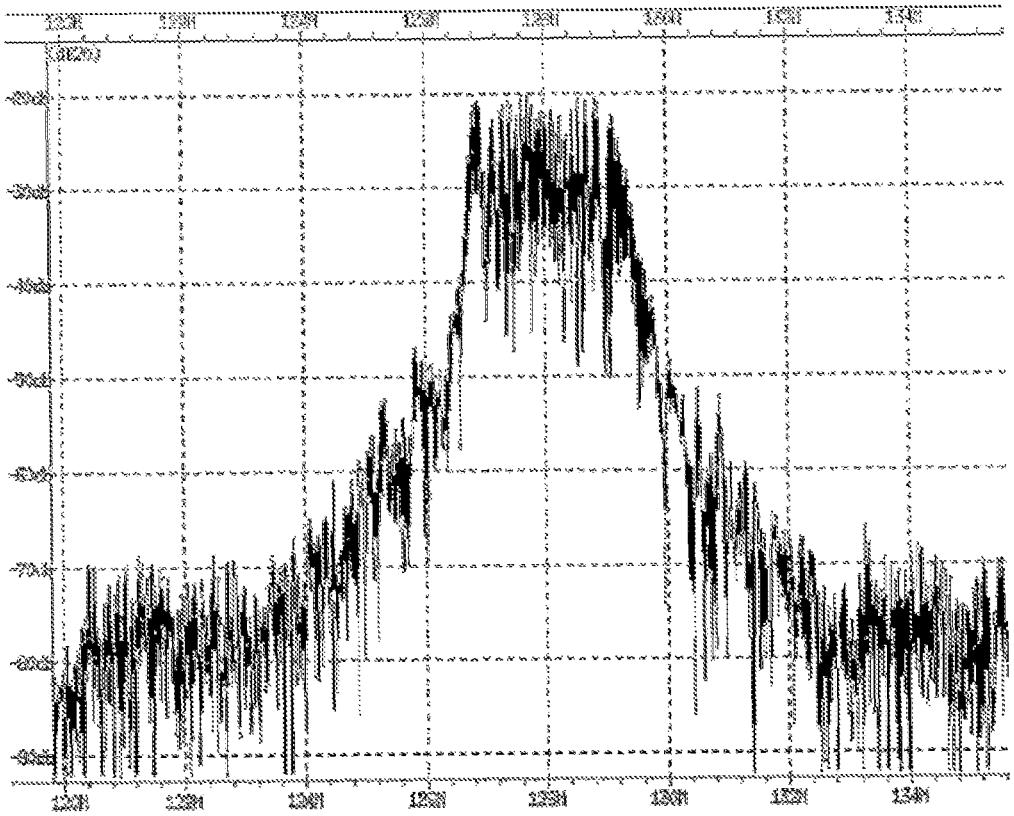
FIG. 7B is a Fast Fourier Transform (FFT) graph of 3 cycles waveform shown in FIG. 7A.

FIG. 7A is a graph showing a triangle shape voltage controlled signal for the VCO 107 and jitter distribution having a 128 MHz clock with a −1.0% to +1.0% modulation depth with synchronous start control. FIG. 7B is a Fast Fourier Transform (FFT) graph of 3 cycles waveform shown in FIG. 7A.

FIG. 7A shows a waveform of a triangle shape voltage controlled signal for the VCO with a −1.0% to +1.0% modulation depth and the jitter distribution curve of the same.

The FFT converts a time-domain data into the frequency-domain data. The FFT is a digital implementation of the Fourier transform. FIG. 7B is a FFT graph of 3 cycles waveform of voltage controlled signal from 29.25 μs to 123 μs shown in FIG. 7A. 1.0% of 128 MHz is 1.28 MHz. Thus, a 128 MHz clock with −1.0% to +1.0% modulation depth indicates that the modulation clock is varying within a band of 126.72 MHz to 129.28 MHz. Referring to FIG. 7B, the FFT graph has X-axis of frequencies and Y-axis of a magnitude response in a log scale (dB). The modulation clock has a high magnitude within a band of 126.72 MHz to 129.28 MHz along with X-axis. Thus, FIG. 7B shows that the spread spectrum modulation depth controller 115 successfully spreads the system clock's peaking energy over a band of 126.72 MHz to 129.28 MHz so that it reduces the EMI radiation.

Figure 8:
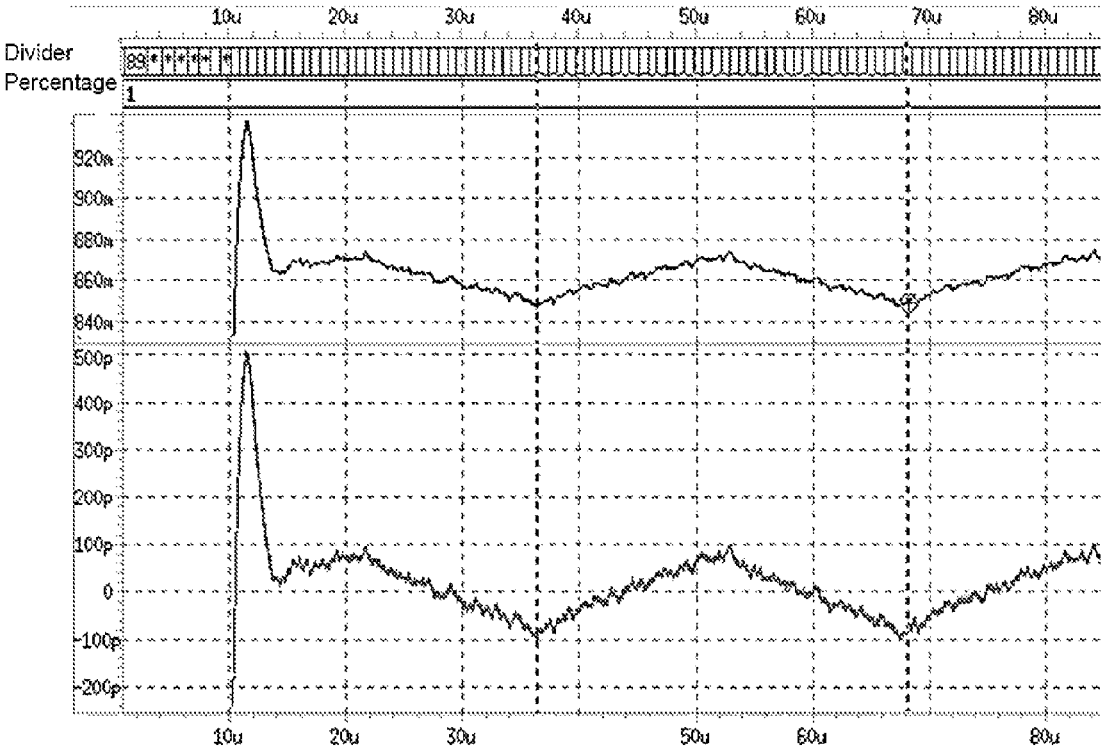
FIG. 8 is a graph showing a control voltage signal for VCO having a 128 MHz clock with a −1.0% to +1.0% modulation depth without synchronous start control.
Figure 9:
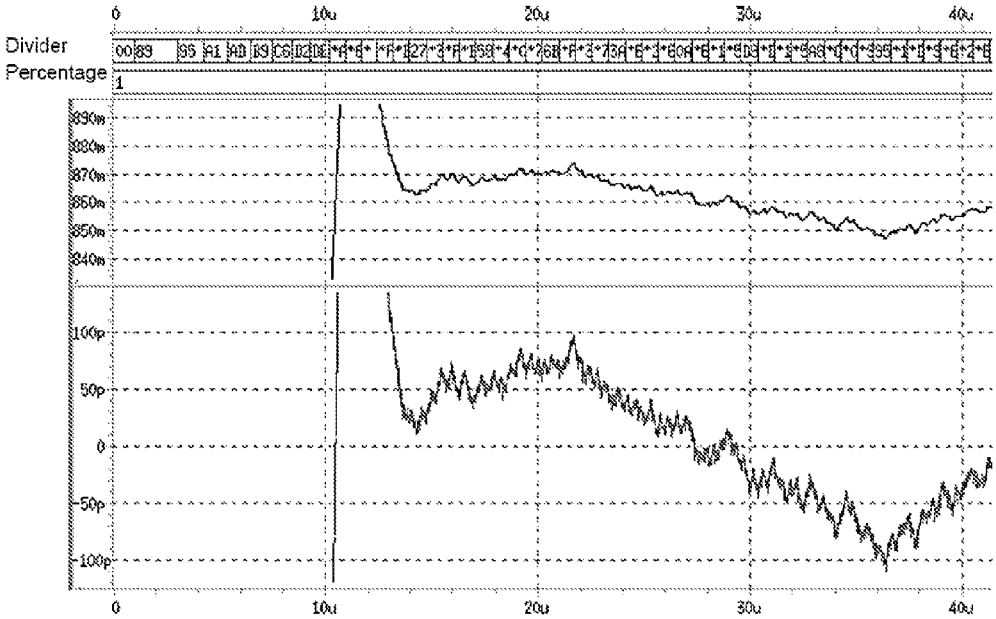
FIG. 9 illustrates an enlarged graph in FIG. 8 in a range of 0 to 40 microsecond.

FIG. 8 is a graph showing a control voltage signal for VCO having a 128 MHz clock with a −1% to +1% modulation depth without synchronous start control. FIG. 9 shows a range of 0 to 40 microsecond in FIG. 8. With reference to FIGS. 8 and 9, the sigma delta modulator 113 generates divider values which feed into the modulus N divider 109. The modulation depth in spread spectrum modulation depth controller 115 is also denoted by the percentage spread 1 at time 0 and the divider starts about 1 μs after time 0. A divider value changes over the modulation period reflecting the fluctuation of the voltage controlled signal for the VCO 107. The X-axis of the graph as shown in FIGS. 8 and 9 indicates a time measured in microseconds (μs). The spread spectrum modulation depth controller can automatically start around time 0 or any given time.

Figure 10:
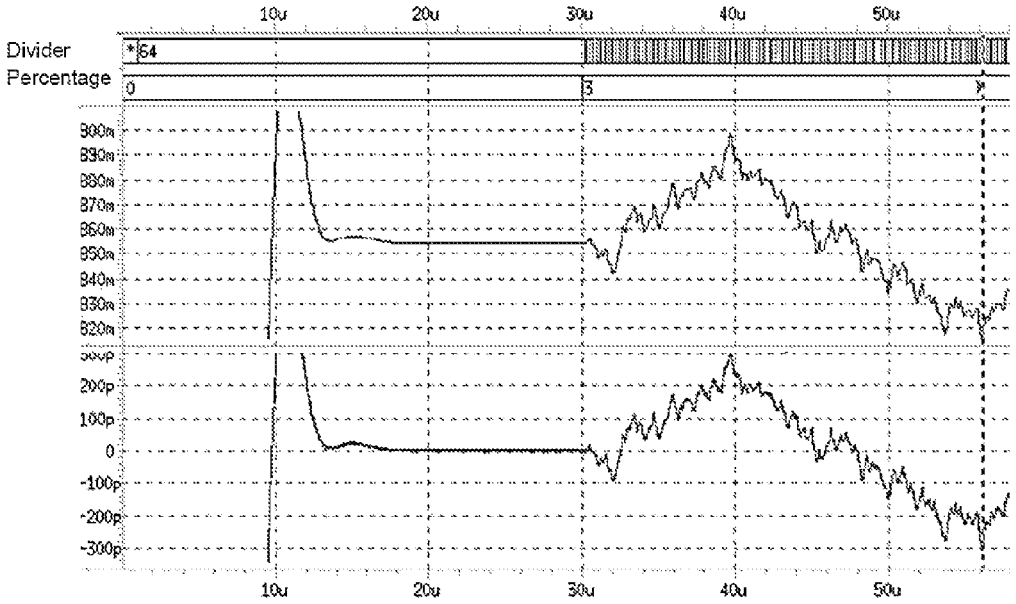
FIG. 10 is a graph showing a control voltage signal for VCO having a 128 MHz clock with a −3.0% to +3.0% modulation depth with synchronous start control.

FIG. 10 is a graph showing a control voltage signal for VCO having a 128 MHz clock with a −3.0% to +3.0% modulation depth with synchronous start control. The spread spectrum modulation depth starts at no spread mode (0%). After a millisecond period of time GCLK of the phase locked loop is locked around 28 μs. After GCLK is locked, the system control unit 10 changes the spread spectrum modulation depth from 0% to 3.0% at 30 μs. Upon receipt of the synchronization start signal, the spread spectrum modulation depth controller 115 starts its process right after the spread spectrum modulation depth has changed.

Figure 11:
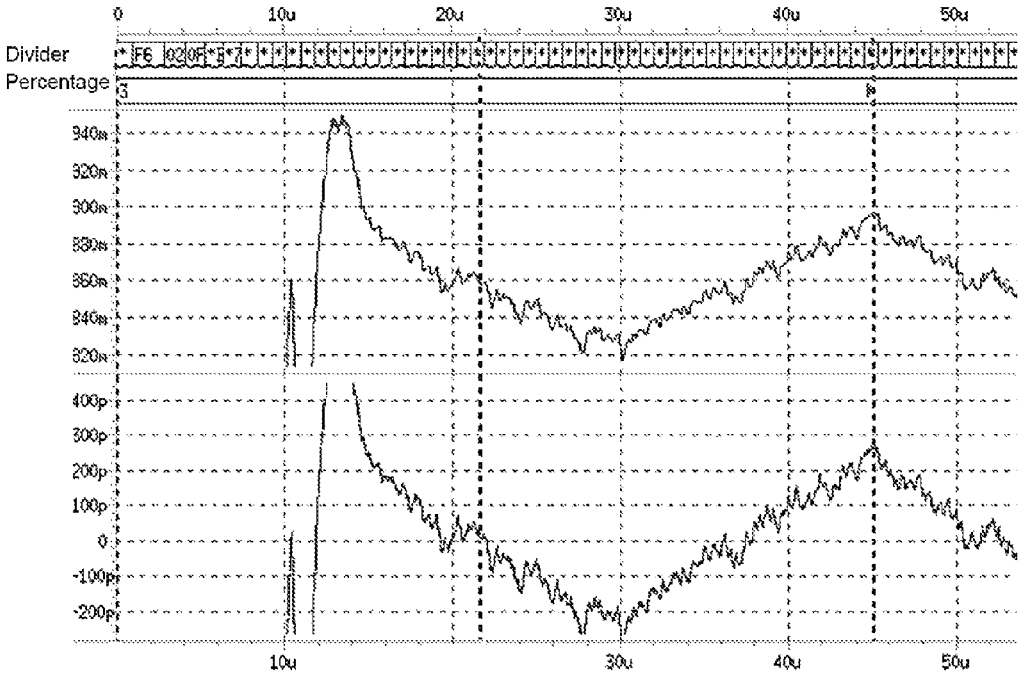
FIG. 11 is a graph showing a control voltage signal for VCO having a 128 MHz clock with a −3.0% to +3.0% modulation depth without synchronous start control.

FIG. 11 is a graph showing a control voltage signal for VCO having a 128 MHz clock with a −3.0% to +3.0% modulation depth without synchronous start control. With reference to FIG. 11, the sigma delta modulator 113 generates divider values which feed into the modulus_N divider 109. The modulation depth in spread spectrum modulation depth controller 115 is also denoted by the percentage spread 3% at Time 0. A divider value changes over the modulation period is reflected to the fluctuation of the voltage controlled signal for the VCO 107.

Figure 12:
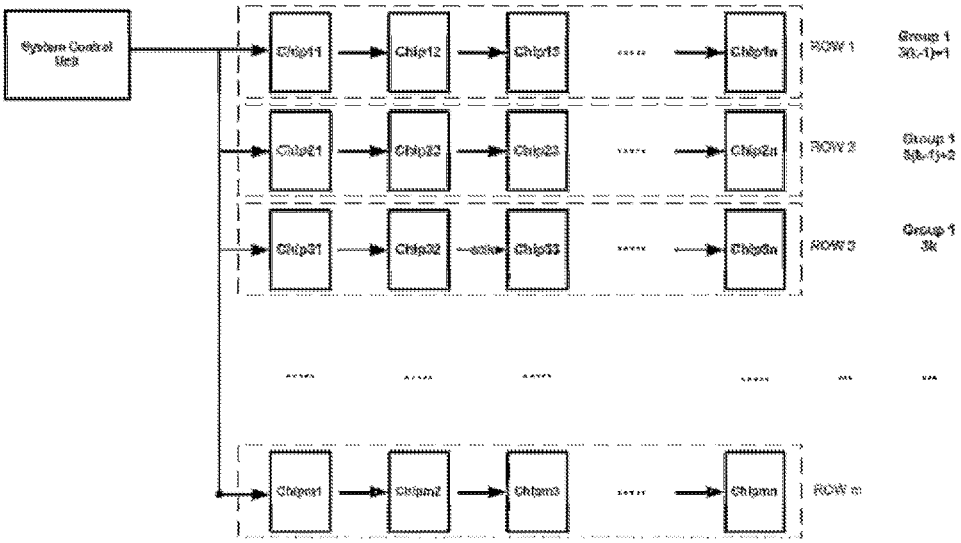
FIG. 12 is a schematic block diagram of an LED array having a plurality (M×N) of LED driver chips according to another embodiment of the present disclosure.

According to another embodiment of the present disclosure, the system control unit 10 manages the synchronization with variation of the LED driver chips by controlling the synchronization start signals. FIG. 12 is a schematic block diagram of an LED array having plurality (M×N) of LED driver chips. The apparatus for driving LED display 1 includes a plurality of LED driver chips. Each of the LED driver chips include a phase locked loop.

The plurality of LED driver chips can be divided into a set of groups. For example, with reference with FIG. 12, the plurality of LED driver chips arranged in N rows (row 1, row 2, row 3, . . . , row N). The plurality of LED driver chips are divided into 3 groups in accordance with locations. Groups 1, 2 and 3 include row 3(k−1)+1, row 3(k−1)+2, and row 3k respectively, where k is an integer.

Figure 13:
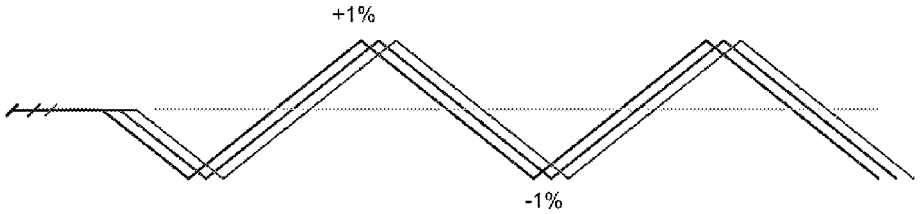
FIG. 13 shows three triangular modulate profiles with timing difference among themselves.

The system control unit 10 can transmit three (3) synchronization start signals to the three (3) groups at a different time to control the synchronization with variation. FIG. 13 shows three triangular modulate profiles with timing difference among group 1, group 2 and group 3. The time differences among the three (3) groups are adjustable and can be managed smaller than a predetermined time difference.

More specifically, for example, the system control unit 10 transmits synchronization start signals 1, 2 and 3 to the group 1 at x μs, to the group 2 at x+y μs, and to the group 3 at x+2y μs respectively. By changing the value of x and y, the time differences among the groups can be changed. Within the same group, the spread spectrum modulation depth controllers synchronously start according to the same synchronization start signal. Depending on the value of x and y, each group starts at a different time so that it further spreads the system clock's peaking energy among the groups so as to reduce the EMI radiation.

Figure 14:
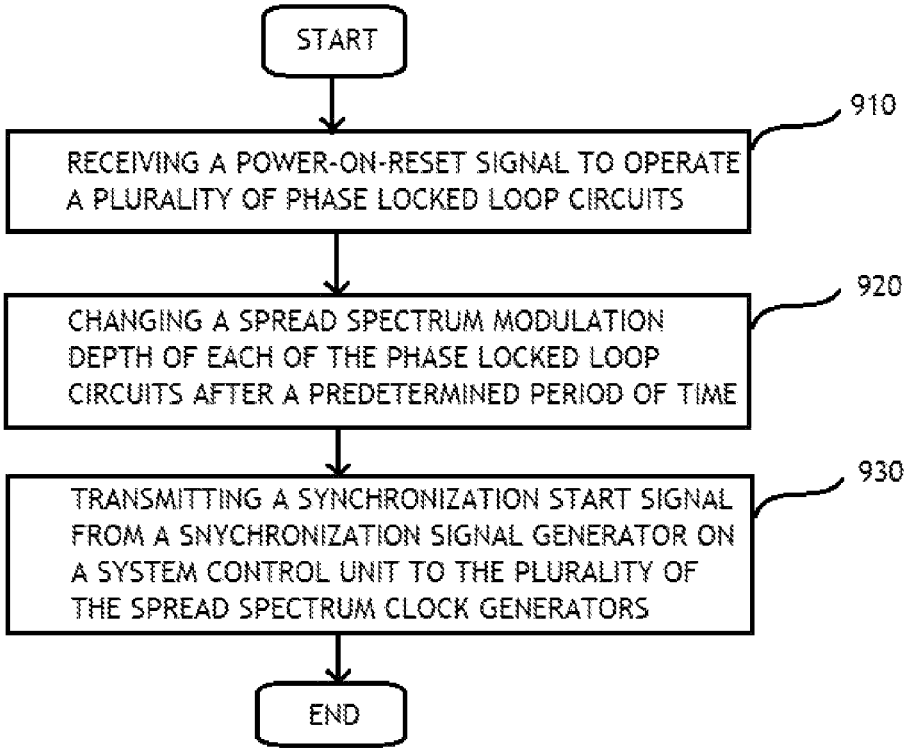
FIG. 14 is a schematic flowchart of synchronization with variation.

FIG. 14 is a schematic flowchart of the method for synchronizing a plurality of the LED driver chips with variation. Step 910 refers to a step of receiving a power-on-reset signal to operate a plurality of phase locked loop circuits. Step 920 refers to a step of changing a spread spectrum modulation depth of each of the phase locked loop circuits after a predetermined period of time. Step 930 refers to a step of transmitting a synchronization start signal from a synchronization signal generator on a system control unit to the plurality of the spread spectrum modulation depth controllers so as to start a spread spectrum modulation process. Each of the spread spectrum modulation depth controllers is coupled to each of the phase locked loop circuits.

It is to be understood that the exemplary embodiments described herein are that for presently embodiments and thus should be considered in a descriptive sense only and not for purposes of limitation. The modifications and embodiments are intended to be included within the scope of the dependent claims. Descriptions of features or aspects within each embodiment should typically be considered as available for other similar features or aspects in other embodiments. Many modifications and other embodiments of the disclosure will come to the mind of one skilled in the art having the benefit of the teaching presented in the forgoing descriptions and the associated drawings.

What is claimed is:

1. An apparatus for driving LED display, comprising:

a system control unit comprising a synchronization signal generator configured to generate a synchronization start signal; and a plurality of phase locked loop circuits, each of the phase locked loop circuits comprising:

a phase frequency detector configured to generate a phase difference signal according to a frequency divided signal and a reference frequency signal;

a charge pump configured to receive the phase difference signal and to generate an output current according to the phase difference signal to adjust phase alignment;

a loop filter configured to receive the output current and to convert the output current to a voltage controlled signal;

a voltage controlled oscillator configured to receive the voltage controlled signal and to generate a voltage controlled output signal;

a divider configured to receive the voltage controlled oscillator and a randomized number, and having a dividing ratio, wherein the dividing ratio is changing over a modulation period;

a sigma delta modulator configured to generate the randomized number to the divider; and a spread spectrum modulation depth controller coupled to the sigma delta modulator and configured to receive the synchronization start signal from the synchronization signal generator, wherein upon receipt of the synchronization start signal the spread spectrum modulation depth controller starts a spread spectrum modulation, wherein the synchronization signal generator transmits the synchronization signal to the spread spectrum modulation depth controller after the system control unit changes a spread spectrum modulation depth of the spread spectrum modulation depth controller.

2. The apparatus of claim 1 wherein the spread spectrum modulation depth is in a range of −100% to 100%.

3. The apparatus of claim 1, wherein the system control unit changes the spread spectrum modulation depth of the spread spectrum modulation depth controller after a predetermined period of time from when each of the phase locked loop circuits receives a power on reset signal.

4. The apparatus of claim 3, wherein the predetermined period of time is a time when the phase locked loop circuits are locked up.

5. The apparatus of claim 3 wherein the predetermined period of time is less than 200 milliseconds.

6. The apparatus of claim 1, wherein the plurality of phase locked loop circuits are divided into a plurality of groups in accordance with locations and the synchronization signal generator transmits a plurality of synchronization start signals to the plurality of groups respectively with a time difference.

7. The apparatus of claim 6, wherein the apparatus is a LED display panel having an array of rows and columns, and the rows and columns are divided into the plurality of groups.

8. The apparatus of claim 6, wherein the time difference is controlled by the system control unit.

9. The apparatus of claim 6, wherein the time difference is smaller than a predetermined time difference.

10. A method for driving LED display, the method comprising:

receiving a power-on-reset signal to operate a plurality of phase locked loop circuits;

changing a spread spectrum modulation depth of each of the phase locked loop circuits after a predetermined period of time;

transmitting a synchronization start signal from a synchronization signal generator on a system control unit to the plurality of the spread spectrum modulation depth controllers so as to start a spread spectrum modulation process;

wherein each of the spread spectrum modulation depth controllers is coupled to each of the phase locked loop circuits, wherein the predetermined period of time is less than 200 milliseconds.

11. The method of claim 10, wherein the predetermined period of time is a time when the phase locked loop circuits are locked up.

12. The method of claim 10, wherein the step of transmitting the synchronization start signal includes to transmit the synchronization start signal to the plurality of spread spectrum modulation depth controllers all together so that the plurality of spread spectrum modulation depth controllers start the spread spectrum modulation process synchronously.

13. The method of claim 10, wherein the plurality of phase locked loop circuits are divided into a set of groups in accordance with locations, and the step of transmitting the synchronization start signal includes a step of transmitting a plurality of synchronization start signals from the synchronization signal generator to the groups respectively with a time difference.

14. The method of claim 13, wherein the plurality of spread spectrum modulation depth controllers are a part of a LED display panel having an array of rows and columns, and the rows and columns are divided into the groups.

15. The method of claim 13, wherein the time difference is controlled by a system control unit.

16. The method of claim 13, wherein the time difference is smaller than a predetermined value.

17. The method of claim 10, wherein the synchronization start signal is transmitted after changing the spread spectrum modulation depth.

18. The method of claim 10, wherein the spread spectrum modulation depth is in a range of −100% to 100%.

19. An apparatus for driving LED display comprising:

a system control unit comprising a synchronization signal generator configured to generate a synchronization start signal; and a plurality of phase locked loop circuits, each of the phase locked loop circuits comprising:

a phase frequency detector configured to generate a phase difference signal according to a frequency divided signal and a reference frequency signal;

a charge pump configured to receive the phase difference signal and to generate an output current according to the phase difference signal to adjust phase alignment;

a loop filter configured to receive the output current and to convert the output current to a voltage controlled signal;

a voltage controlled oscillator configured to receive the voltage controlled signal and to generate a voltage controlled output signal;

a divider coupled to the voltage controlled oscillator and configured to change the dividing ratio over a modulation period;

a sigma delta modulator configured to generate random numbers to the divider; and a spread spectrum modulation depth controller coupled to the sigma delta modulator and configured to receive the synchronization start signal from the synchronization signal generator, wherein upon receipt of the synchronization start signal the spread spectrum modulation depth controller starts a spread spectrum modulation, and the synchronization signal generator transmits the synchronization signal to the spread spectrum modulation depth controller after the system control unit is configured to change the spread spectrum modulation depth of the spread spectrum modulation depth controller, and the system control unit changes the spread spectrum modulation depth of the spread spectrum modulation depth controller after a predetermined period of time from when the phase locked loop circuits are locked up, and wherein the plurality of phase locked loop circuits are divided into a plurality of groups in accordance with locations, and the synchronization signal generator transmits a plurality of synchronization start signals to the plurality of groups respectively with a time difference.

* * * * *